US008028847B2

(12) United States Patent
Klaver et al.

(10) Patent No.: US 8,028,847 B2
(45) Date of Patent: Oct. 4, 2011

(54) BABY BOTTLE AND METHOD OF CREATING INFANT FORMULA

(76) Inventors: Jerell Klaver, Larkspur, CO (US); Elissa Klaver, Larkspur, CO (US)

( * ) Notice: Subject to any disclaimer, the term of this patent is extended or adjusted under 35 U.S.C. 154(b) by 909 days.

(21) Appl. No.: 12/016,156

(22) Filed: Jan. 17, 2008

(65) Prior Publication Data

US 2009/0184080 A1 Jul. 23, 2009

(51) Int. Cl.
*B65D 1/04* (2006.01)
*A61J 9/00* (2006.01)

(52) U.S. Cl. ..... 215/6; 215/11.1; 215/DIG. 8; 220/4.27; 220/502

(58) Field of Classification Search ..... 220/4.26, 220/4.27, 502; 215/11.1, 6, DIG. 8
See application file for complete search history.

(56) References Cited

U.S. PATENT DOCUMENTS 4,703,863 A * 11/1987 Kohus ..... 215/11.1
4,778,068 A * 10/1988 Kohus ..... 215/11.1
4,779,722 A * 10/1988 Hall ..... 206/221
4,818,114 A 4/1989 Ghavi
4,823,946 A * 4/1989 Stoeffler et al. ..... 206/221
5,361,918 A 11/1994 Mason
5,419,445 A 5/1995 Kaesemeyer
5,433,328 A 7/1995 Baron et al.
5,638,968 A 6/1997 Baron et al.
5,678,709 A 10/1997 Holley et al.
5,794,802 A 8/1998 Caola
5,863,126 A 1/1999 Guild
6,027,392 A * 2/2000 Ruhlman ..... 446/75
6,045,254 A 4/2000 Inbar et al.
6,116,439 A 9/2000 Yaniv
7,150,369 B1 12/2006 Fryar
7,850,027 B2 * 12/2010 Hayes et al. ..... 215/11.4
2004/0188371 A1 9/2004 Holley, Jr.
2005/0263475 A1 12/2005 Carlson et al.
2006/0273059 A1 * 12/2006 Mendenhall et al. ..... 215/11.1
2007/0017890 A1 * 1/2007 Al-Jadh ..... 215/11.1
2007/0221601 A1 * 9/2007 Eitrheim et al. ..... 215/6
2007/0284329 A1 * 12/2007 Hayes et al. ..... 215/11.1
2009/0178940 A1 * 7/2009 Said ..... 206/221
2009/0301905 A1 * 12/2009 Bullard et al. ..... 206/221
2010/0072160 A1 * 3/2010 Hayes ..... 215/11.1

* cited by examiner

*Primary Examiner* — Mickey Yu
*Assistant Examiner* — Niki Eloshway
(74) *Attorney, Agent, or Firm* — Leyendecker & Lemire, LLC; Kurt Leyendecker

(57) ABSTRACT

A baby bottle comprising a first compartment and a second compartment. The first compartment comprised a proximal end and a distal end. The proximal end is comprised of at least one substantially open bore. The distal end is comprised of at least one partially closed port and a stabilization coupling mechanism first portion. The second compartment is comprised of a first end and a second end. The first end of one embodiment comprises a partially closed cavity and a stabilization coupling mechanism second portion. The stabilization coupling mechanism second portion may be adapted to mate with the stabilization coupling mechanism first portion. Furthermore, the first end may be adapted to couple to the first compartment distal end. The second end of one embodiment may have a substantially open bore and a removably coupled end cap.

17 Claims, 9 Drawing Sheets

BABY BOTTLE AND METHOD OF CREATING INFANT FORMULA

FIELD OF THE INVENTION

This invention generally relates to baby bottles.

BACKGROUND

Infants require a specific amount of nutrients each day. These nutrients are often provided through a mother's milk. However, there are times when the mother is not available to provide milk or is unable or unwilling to provide milk to her newborn. In order to provide the baby the nutrients that are required, babies are often fed a mixture called "formula". Formula is a powdered substance often mixed with water to create a liquid solution that the baby can intake into his or her body to receive the nutrients.

Feeding a child liquid formula created from a powdered mixture using prior art mixing devices and baby bottles can be complicated, costly, and/or messy. For example, prior art formula may be premixed. In this instance, the formula mixture is created before the baby is hungry, so it is ready as soon as the baby needs it. However, pre-making a formula mixture is not always an available method of providing an infant his or her required nutrients as it is typically recommended that premixed formula be consumed within one hour of creation as it may spoil if it is not consumed within that timeframe.

Extending the consumption period for a pre-mixed batch of formula may be accomplished through cooling the pre-mixed formula—potentially with a cold pack or ice. However, the formula mixture must usually be heated prior to giving the mixture to the baby. Cooling and heating takes extra time and/or equipment, so it is not always conducive to undertake these steps—when traveling, for example. Therefore, pre-mixed formula often spoils prior to consumption, wasting the formula and in the process increasing costs.

Prior art devices which are adapted to keep the powdered formula separate from the mixing liquid until the time the two are to be mixed are deficient in many respects. For example, current devices do not operate appropriately—they become clogged during the mixing process, for example, or they may be difficult to clean. Furthermore, many systems are comprised of internal liners, which are difficult to use and may introduce foreign material into the formula once the liner is torn. Many of these prior art devices are further deficient because they require the use of two or more devices to keep the powder separate from the liquid. Furthermore, the device may require a complicated movement to mix the powder with the liquid, which is difficult to perform. Other devices may not allow for the device to be reusable or may not allow for the purchase of bulk formula powder.

DETAILED DESCRIPTION

Figure 1:
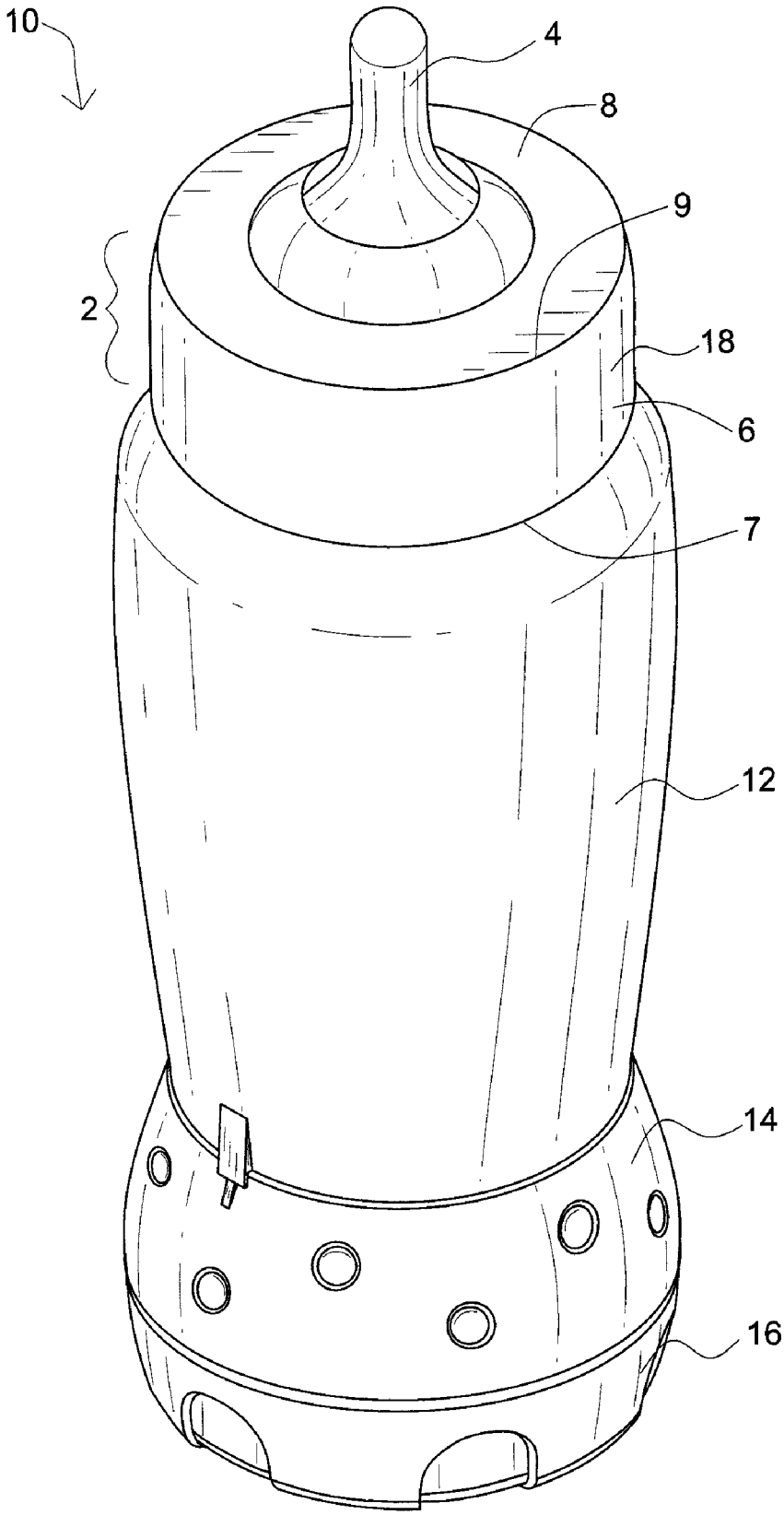
FIG. 1 is an isometric view of a baby bottle according to one embodiment of the invention.

In order to alleviate the problems associated with prior art infant formula mixing devices, a new baby bottle design has been developed. Embodiments of this baby bottle provide a user with a baby bottle design that is easy to clean, operate, maintain, and is cost effective. One embodiment allows a predetermined amount of liquid and powder be kept in a single device, allowing for easy mixture of the two upon a user performing a simple operation. Therefore, premixing formula is no longer required since formula can be made on a moment's notice. As keeping premixed formula from spoiling by cooling and heating the mixture is no longer required, one embodiment of a new baby bottle design allows for longer formula shelf-life than premixed formula.

A version of a baby bottle may be comprised of a polymeric material. The material may be easy to clean and dishwasher-safe. One embodiment's baby bottle material may be lighter than prior art bottles. Having a lighter bottle may make it easier for a person to carry one or more baby bottles.

One embodiment of a baby bottle may be comprised of two compartments. A first compartment may be adapted to couple to a second compartment. The first compartment may also be adapted to couple to a lid, wherein, the lid may have a polymeric nipple attachment. One portion of the second compartment may be comprised of an end cap. The end cap may detachably couple to an end of the second compartment and may be adapted to enable easier cleaning of the second compartment, among having other attributes.

The first compartment may be further comprised of a first section of a stabilization coupling mechanism and may have a partially closed distal end. The second compartment may have a partially closed first end and may have a second section of a stabilization mechanism. The distal end may be adapted to couple to the first end. The two ends may create one of a substantially open position and a substantially closed position. In the substantially open position, there is an opening between the two compartments, essentially creating one large compartment. In the substantially closed position, there may be a seal between the two compartments, keeping the two compartments substantially separate. The stabilization mechanism sections are adapted to secure the two compartments in the substantially open or the substantially closed position.

In one method, an amount of formula adapted to provide an infant with required nutrients may be measured. The formula amount may be a specified amount provided from a physician or according to formula directions. The measured formula amount may be placed onto an uncoupled end cap or, after coupling the end cap to the second compartment, into the second compartment. In another embodiment, the measured formula amount may be placed into the second compartment, which is coupled to the first compartment in a locked closed position. The end cap may then be coupled to the second compartment to substantially close the second end. When the end cap is placed on an open second end of the second compartment, the end cap should substantially close the second end.

Upon placing the formula in the second compartment, the second compartment may then be coupled to the first compartment. The two compartments may then be moved to the substantially closed position which may be the locked closed position. This may be done by aligning an open portion of the distal end with a closed portion of the first end. Water may then be poured into the second compartment through an open second compartment proximal end. The lid may then be coupled to the second compartment's proximal end. The first compartment distal end and the second compartment first end may then be moved to the substantially open position when mixing is desired. This may be accomplished by aligning an open distal end portion with an open first end portion.

Moving one embodiment of a baby bottle from the substantially closed position having two separate compartments to a substantially open position having a single compartment may include rotating and generally locking the device in a first position and a second position. For example, in one method, the stabilization coupling mechanism may lock the bottle in a closed first position. One type of stabilization coupling mechanism may be comprised of a flange or a flange pair and a surface extension. In one method using one embodiment, a user may insert an end of one of the first and second compartments into an end of the other of the first and second compartments. The two compartments may then be rotated in opposing directions until the extension is received by the flange or flange pair. This may place the bottle in a closed position. When the formula is ready to be made, the two compartments may then be rotated in opposing direction about 180 degrees, placing the bottle in the open position. Another embodiment may rotate in opposing directions about 90 degrees.

The liquid in the first compartment may then be mixed with the formula in the second compartment. To completely and thoroughly mix the formula and liquid, the bottle may be agitated. For example, the bottle may be shaken repeatedly. Upon mixing the formula, the formula may be allowed to settle and fed to the infant.

Having a substantially closed and a substantially open position, and moving the bottle from the closed position to the open position removes many of the deficiencies with the prior art devices. By creating a seal between the two compartments when in the closed position, the compartments do not leak. Furthermore, by having a large enough opening between the two compartments when in the open position, the device does not become clogged during the mixing process. These two features solve the major problem with prior art devices—having a two compartment device which does not leak, but yet still has a large enough opening between the two that the formula can be easily mixed when so desired.

Terminology:

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, tense or any singular or plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of phrases like "in one embodiment", "in an embodiment", or "in a variation" in various places in the specification are not necessarily all meant to refer to the same embodiment or variation.

The term "couple", "coupled", "coupling", or any variation thereof, as used in this specification and the appended claims refers to either an indirect or direct connection between the identified elements, components or objects. Often the manner of the coupling will be related specifically to the manner in which the two coupled elements interact. Specifically, this term may be used to define two elements joined by a bolted fastener, a latch, a hook, or any other reasonably readily removable fastening device.

The term "integrate" or "integrated" as used in this specification and the appended claims refers to a blending, uniting, or incorporation of the identified elements, components or objects into a unified whole.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

One Embodiment of a Baby Bottle:

As best shown in Figures One through Four and Figure Seven, one version of a baby bottle 10 may be comprised of a first compartment 12 and a second compartment 14. A baby bottle embodiment may also be comprised of an end cap 16, a top section 18, and a lid 19 (the lid is best shown in FIGS. 6A through 6D). As best shown in Figure One, the first compartment may be adapted to couple to the top section and the second compartment. The second compartment may also be adapted to couple to the end cap.

Figure 5:
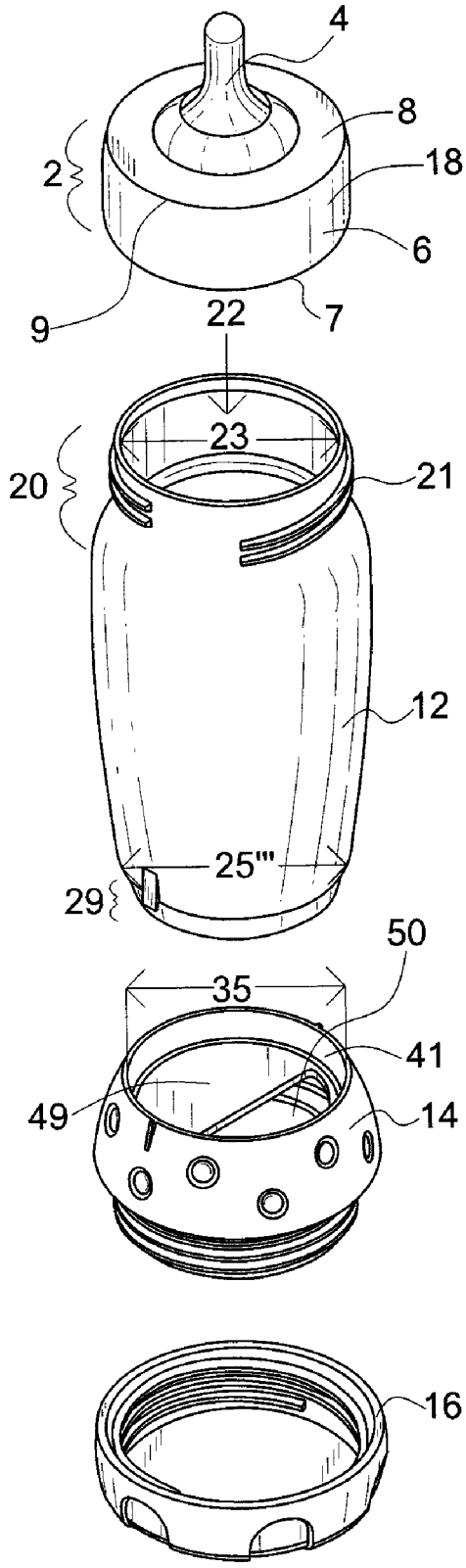
FIG. 5 is an exploded side view of a baby bottle according to one embodiment of the invention.

One embodiment's top section 18 is comprised of an attachment section 2 and fluid dispersion section 4. One top section's attachment section may be generally cylindrical and hollow, having a sidewall 6 and a top 8 as best shown in FIGS. 1 and 5. The sidewall 6 may have a generally circular cross section. The attachment section may be adapted to receive and attach, or couple to, the first compartment 12. The lower end 7 of one hollow attachment section may encircle a bore which may act as inlet or an outlet port for items or liquid to travel into and out of the top section, traveling potentially to the coupled first compartment.

The top 8 of the attachment section 2 may extend from a sidewall edge 9 to the fluid dispersion section 4. The fluid dispersion section may be adapted to substantially prevent liquid from exiting the bottle and yet allow fluid to exit the bottle upon performing a specific action. For example, in one embodiment, the fluid dispersion section may be a polymeric nipple generally centered on the top and adapted to release fluid upon an infant or baby placing his or her mouth on the nipple and drawing the liquid into the baby's mouth through a sucking action. Other fluid dispersion sections are also contemplated, such as, but not limited to, using a "sippy cup" type of device. The fluid dispersion section may also be referred to, or may also have, an inlet or outlet port.

Figure 2A:
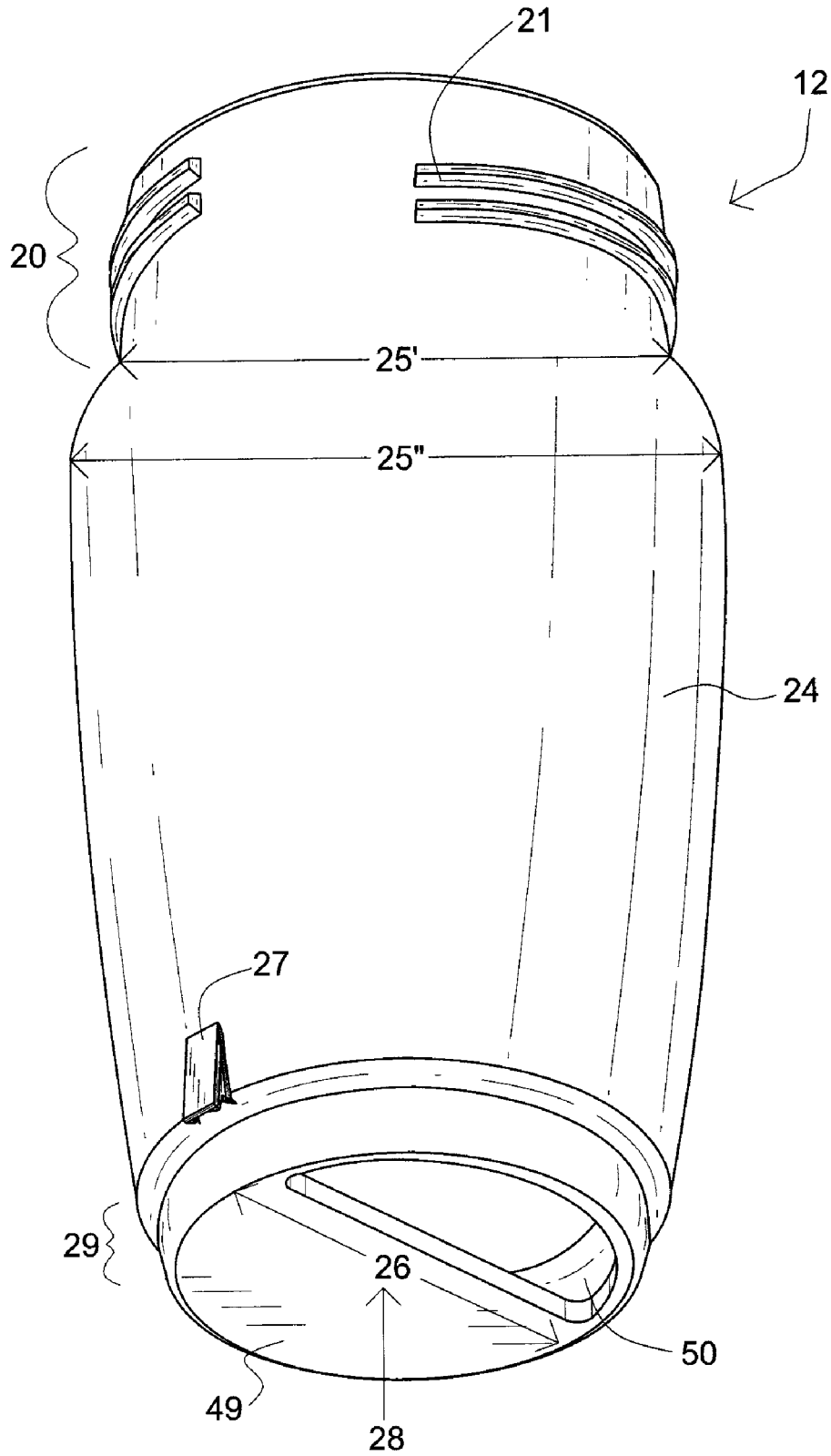
FIG. 2*a* an isometric view of a first compartment having a first version of a stabilization coupling mechanism first portion according to one embodiment of the invention.

As best shown in FIG. 2*a*, one first compartment 12 may be comprised of a proximal end 20 and a distal end 29. In one embodiment, the proximal end may be adapted to couple to the top section 18 and the distal end may be adapted to couple to the second compartment 14. The ends may couple through coupling mechanisms such as, but not limited to, threads 21, or each end may be adapted to snap to the end cap and top section, respectively.

Figure 7:
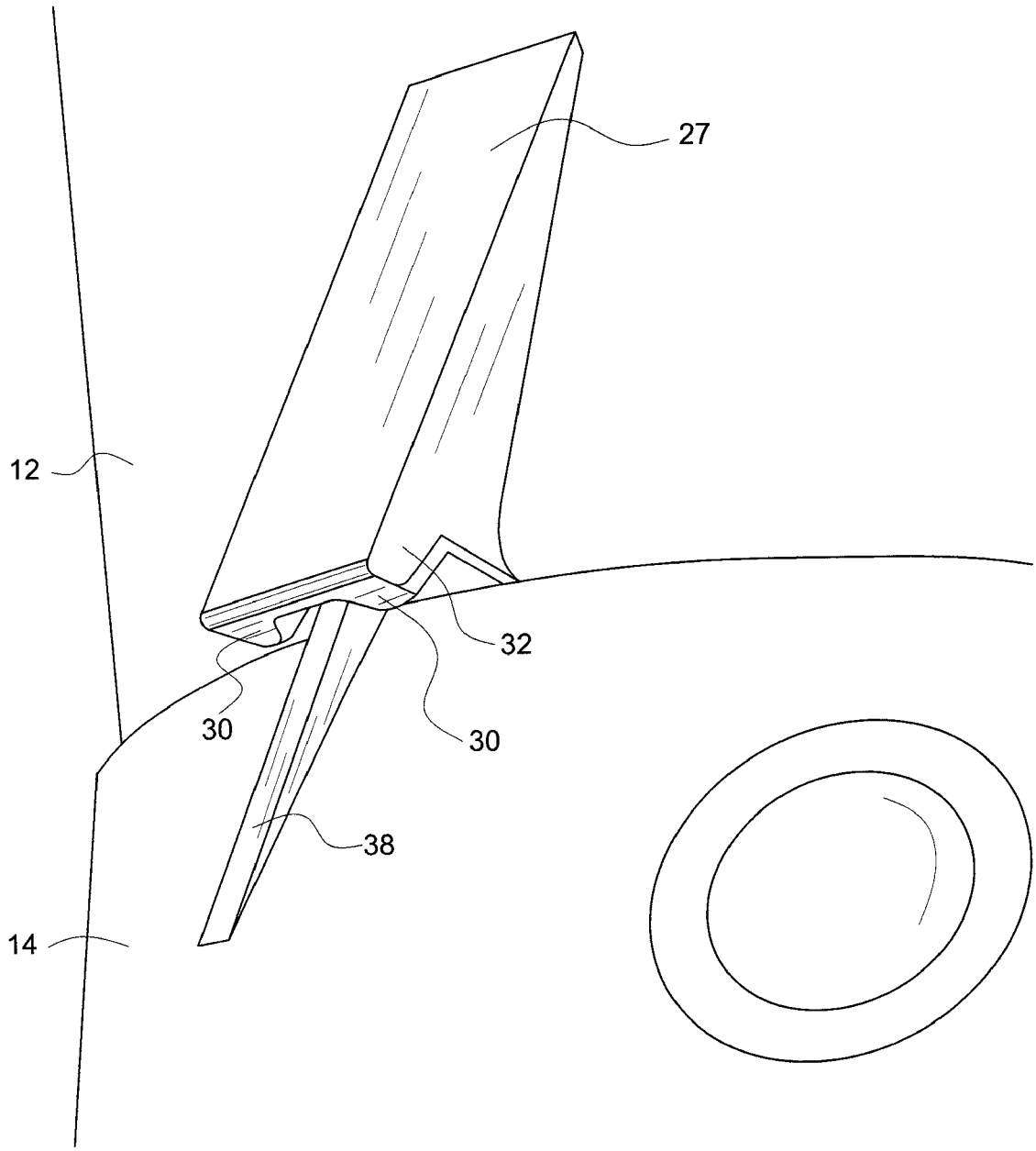
FIG. 7 is an isometric view of a first version of a stabilization coupling mechanism first portion coupled to a first version of a stabilization coupling mechanism second portion according to one embodiment of the invention.

As best shown in FIG. 5, the proximal end 20 of the second compartment may be comprised of a cylinder having threads 21 and a substantially open bore 22. The proximal end may be comprised of external threads adapted to rotatably mate with inner sidewall threads of the top section. The proximal end bore may have a proximal diameter 23 and allow a substance to be placed or flow into and out of the second compartment. The proximal diameter may be generally constant along the length of the proximal end in one embodiment, although some embodiments may have varied diameters. As best shown in FIG. 2*a*, the distal end 29 may be comprised of a partially closed port 28. Furthermore, the distal end may also be comprised of a stabilization coupling mechanism first portion 27. The stabilization coupling mechanism first portion may also be referred to as a first compartment flange, as best shown in FIG. 7.

Figure 3A:
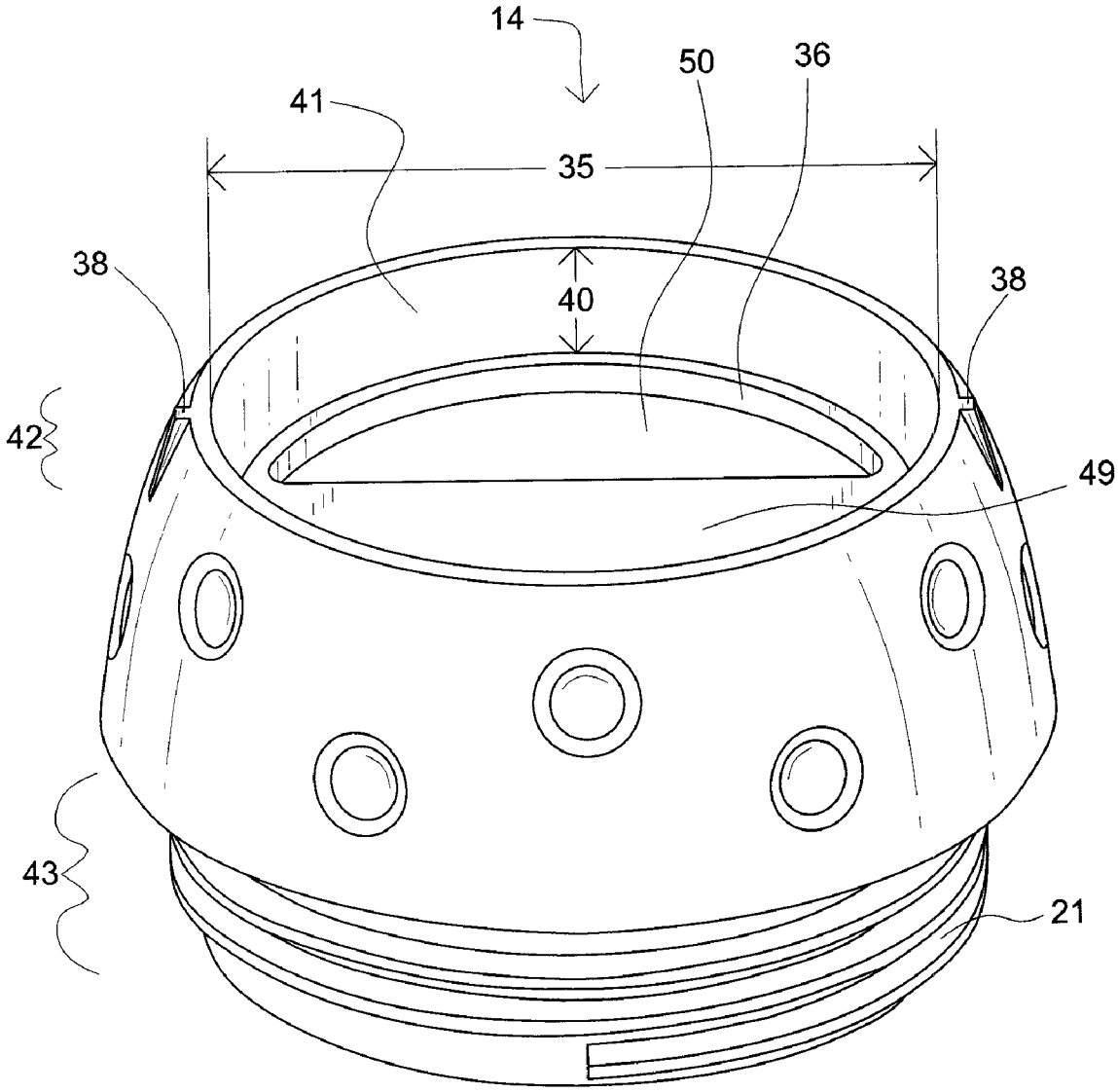
FIG. 3*a* is an isometric view of a second compartment according to one embodiment of the invention having a first version of a stabilization coupling mechanism second portion.
Figure 3B:
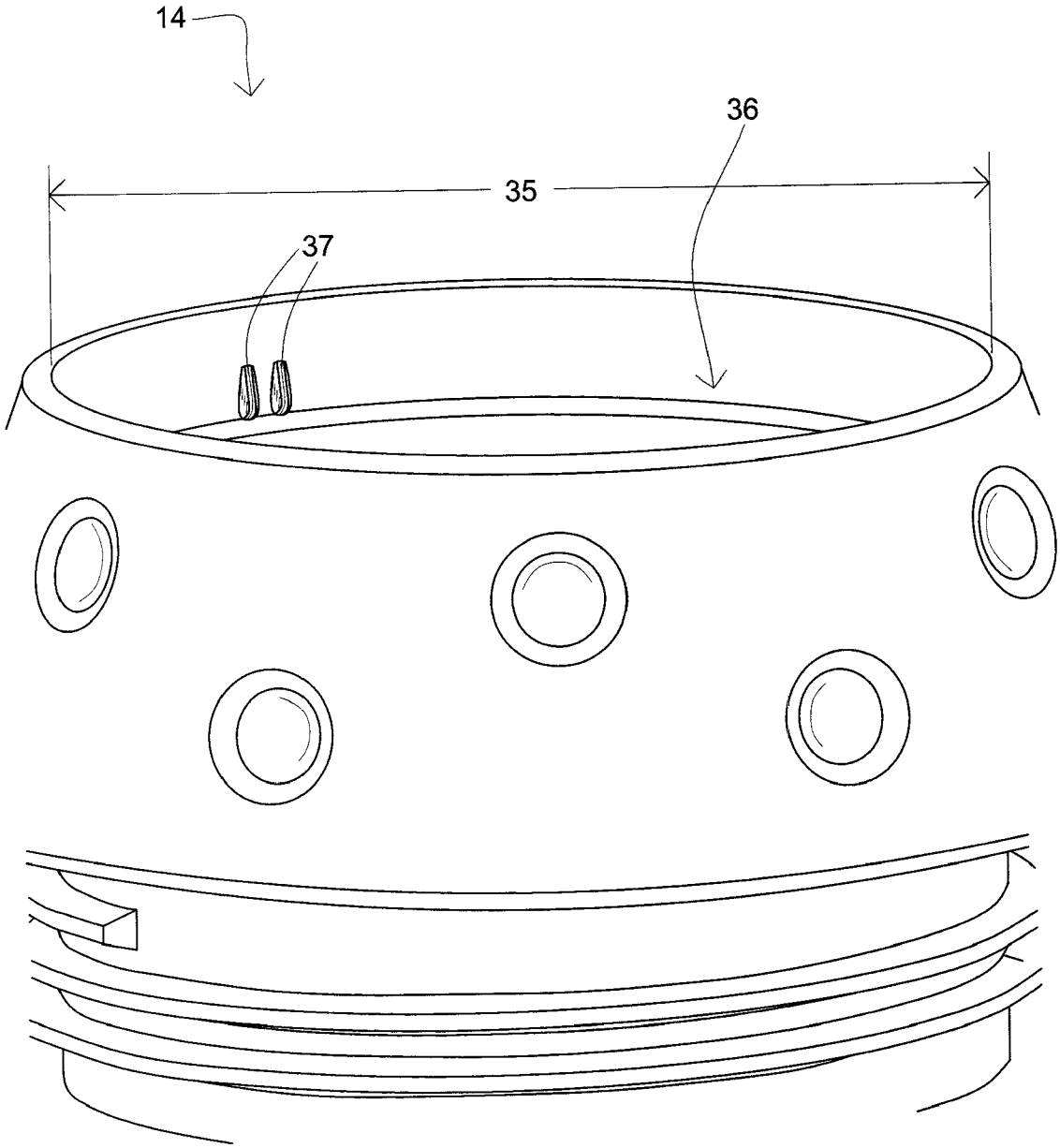
FIG. 3*b* is an isometric view of a second compartment according to one embodiment of the invention having a second version of a stabilization coupling mechanism second portion.
Figure 4:
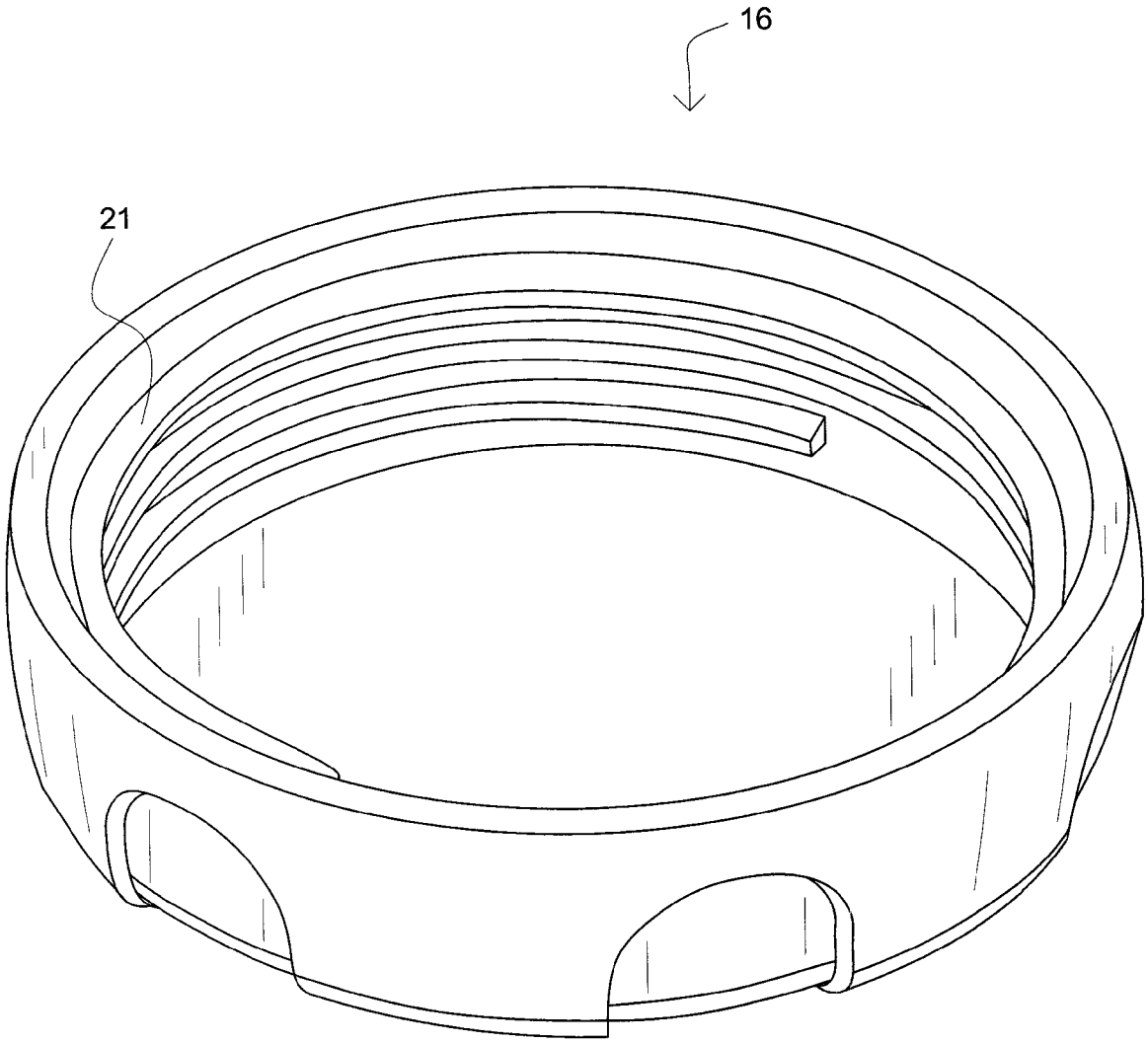
FIG. 4 is an isometric view of an end cap according to one embodiment of the invention.

In one embodiment, the proximal end 20 is integrated to the distal end 29 through a middle section 24. The middle section may be referred to as an enclosure and may be comprised of a generally cylindrically-shaped compartment, and may also have a generally tapered shape. For example, one middle section may expand from a start diameter 25' wherein the start diameter is about equal to the proximal end diameter to a maximum diameter 25", then taper to an end diameter 25''', the end diameter as best shown in FIG. 2*a* being less than the maximum diameter. The distal end 29 may have a distal end diameter 26 which may be less than the middle section end diameter. Furthermore, the distal end in one embodiment may be adapted to fit or snap into a second compartment cavity 36 as best shown in FIG. 3B. Therefore, in one embodiment, the distal end diameter 26 may be less than a second compartment cavity diameter 35. One distal end may comprise a side 34 having a length 33 about equal to the depth 40 of the cavity. The length and width of the cavity and distal end may enable a seal to be created between the distal end side and the cavity wall 41. This seal may substantially prevent a liquid from escaping the baby bottle or traveling between the first compartment and the second compartment. One reason that a seal may occur is through the type of material that is used. For example, the material may be a polymeric material such as that used by the many of the products produced by OXO International of New York, N.Y.

The material used in one first compartment 12 and second compartment 14 may be FDA approved material recognized as safe for food and contact application. Furthermore, the material may comply with European standards as well. For example, compartments may be comprised of the latest European Standard for Drinking Equipment for Children EN14350: 2004 and may be determined by a specific daily intake of BPA for children. For example, one bottle may be comprised of a polycarbonate material wherein different portions or sections of the bottle may be comprised of different colors. Portions of the compartments such as, but not limited to the coupling mechanism first portion 27 may be comprised of material similar to material used in many of the products produced by OXO International of New York, N.Y. For example, this may be an elastomeric material in one embodiment and may be a thermoplastic elastomer.

One first compartment stabilization coupling mechanism first portion 27 comprises at least one flange, as best shown in FIG. 2*a*. The flange may be an external flange. For example, the flange may be located on an outer surface of the middle section 24. Furthermore, the flange may be comprised of an extension portion 32, as best shown in FIG. 7. One extension portion may be adapted to extend below a lower edge 31 of the middle section. One embodiment may be comprised of two or more external flanges generally located on opposing sides of the middle section. One embodiment may be comprised of a flange having a plurality of ridges 30, and one flange may be comprised of a pair of ridges on an inner flange side. The flange may be adapted to couple to a second compartment stabilization coupling mechanism second portion. One stabilization coupling mechanism second portion may be an extension 38 located on an outer surface of the second compartment 14 or a pair of extensions generally located on opposing second compartment sides, as best shown in FIG. 3*a*. The second compartment extensions may be referred to as flanges. One extension may couple to the stabilization coupling mechanism first portion by being received by at least one flange. Upon receiving the extension, the stabilization coupling mechanism may keep the second compartment 14 in generally the same position relative to the first compartment 12.

Figure 2B:
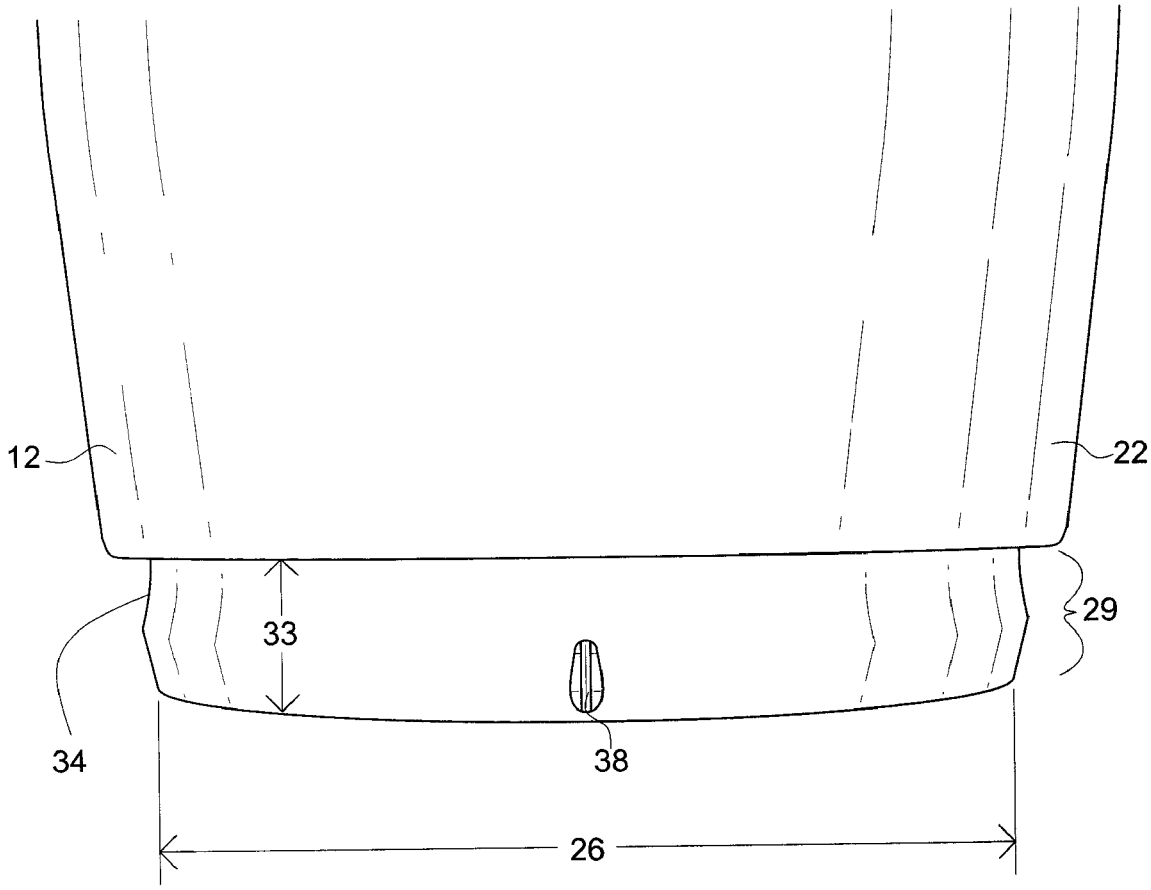
FIG. 2*b* is a side view of a distal end of a second compartment having a second version of a stabilization coupling mechanism first portion according to one embodiment of the invention.

One embodiment of a baby bottle 10 may be comprised of a second version of a stabilization coupling mechanism. As best shown in FIGS. 2*b* and 3*b*, the first compartment 12 may have a stabilization coupling mechanism first portion 27 which is comprised of at least one outer distal end surface extension 38 and the second compartment may have at least one pair of flanges 37 adapted to receive the extension. Similar to the stabilization coupling mechanism first version, as best shown in FIG. 7, the second version is adapted to generally stabilize the first and second compartments relative to each other. In one second version, as best shown in FIGS. 2*b* and 3*b*, the first compartment distal end 29 is adapted to snap into the cavity 36 in a manner similar to the first version.

As best shown in FIGS. 3*a* and 3*b*, one second compartment 14 may be comprised of a first end 42 and a second end 43. One first end may be comprised of a partially closed cavity 36 and a stabilization coupling mechanism second portion. One stabilization coupling mechanism second portion may be adapted to mate with the stabilization coupling mechanism first portion 27. For example, the second portion may be the extensions 38. As best shown in FIG. 3*b*, the second portion may also be at least one pair of inner surface extensions adapted to receive the stabilization mechanism first portion. One first end may be adapted to receive and couple to the first compartment distal end 29. One second end may have a having a substantially open end. For example, the second end may be comprised of a bore. Furthermore, the second end may be adapted to removably receive an end cap 16. For example, the second end may have external threads 21 adapted to rotatably mate with internal end cap threads.

As best shown in FIGS. 2*a* and 3*a*, the distal end 29 and the first end 42 are each comprised of a partially closed end, respectively. Each partially closed end is respectively comprised of an open portion 50 and a closed portion 49. The closed portion in one embodiment may be comprised of less than half of the surface area of each respective end. Therefore, the open portion 50 of the first compartment is adapted to be sealed by the closed portion of the second compartment, and vice versa.

One first compartment 12 may have a length of about 4.5 inches with a start diameter 25' of about 2 inches. Other embodiments may have a larger sized first compartment, with a length of about 6 inches and a diameter of about 3 inches. One second compartment 14 may have a similar diameter to the first compartment and may have a length of about 1.5 inches in one embodiment and a 2.5 inch length in another embodiment.

Figure 6D:
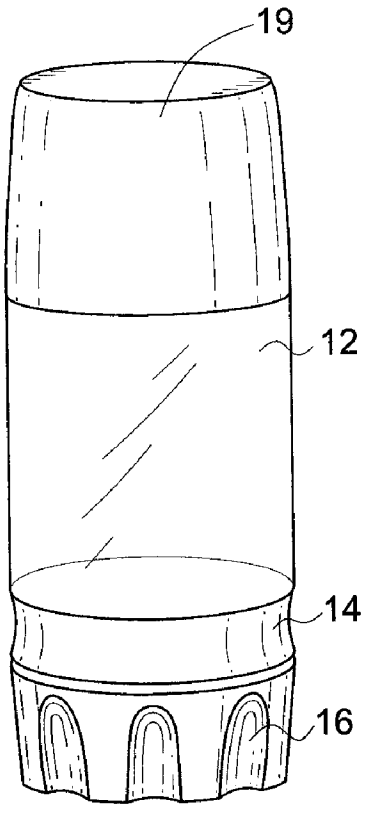
FIG. 6D is an isometric view of a version of a baby bottle according to one embodiment of the invention.
Figure 6C:
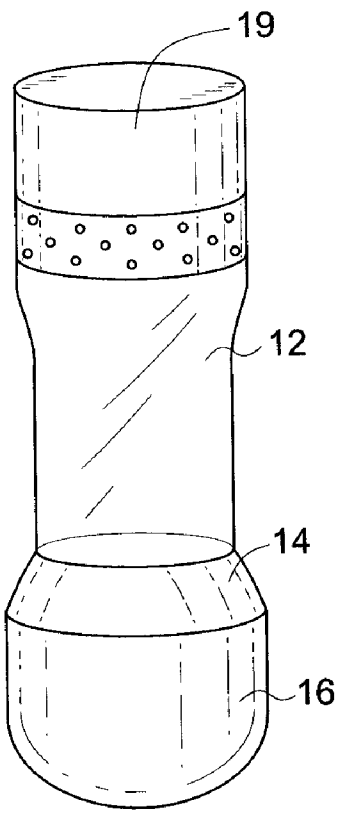
FIG. 6C is an isometric view of a version of a baby bottle according to one embodiment of the invention.
Figure 6B:
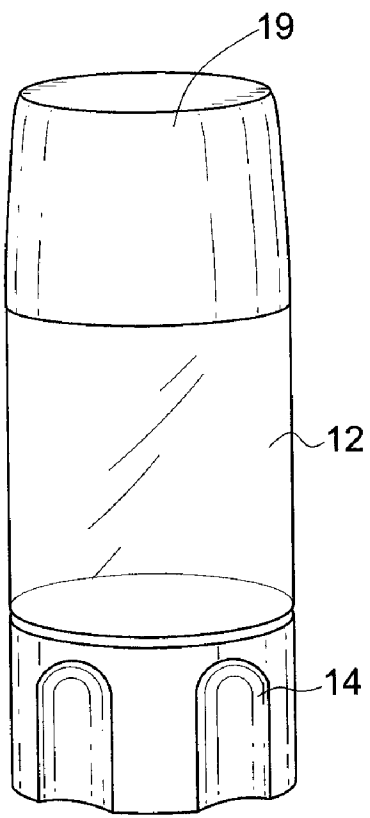
FIG. 6B is an isometric view of a version of a baby bottle according to one embodiment of the invention.
Figure 6A:
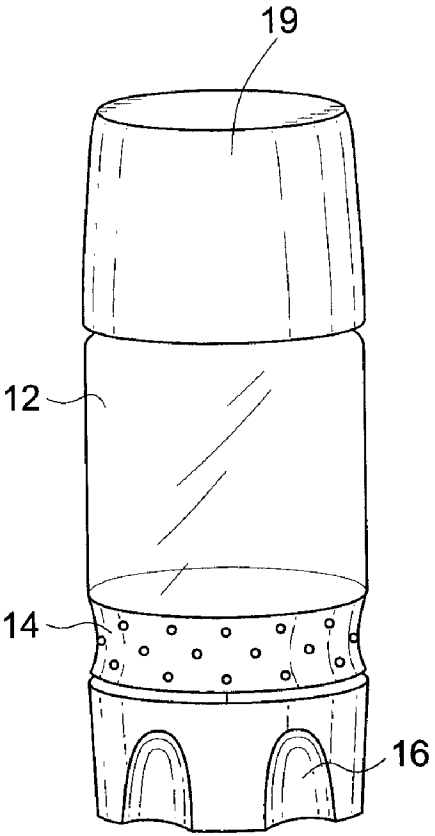
FIG. 6A is an isometric view of a version of a baby bottle according to one embodiment of the invention.

One Method of Preparing Infant Formula:

As best shown in FIGS. 5 through 6D, one method of preparing infant formula is comprised of using a baby bottle having a first compartment 12 and a second compartment 14. The bottle may also be comprised of an end cap 16, a top section 18, and a lid 19. In one method, a desired amount of infant formula is measured. This may be an amount which is appropriate to provide an infant a desired amount of nutrients. Furthermore, the amount of infant formula used may be sufficient to dissolve into an amount of liquid placed within a first compartment 12.

In one method, the formula is placed into the second compartment 14. However, the formula may be placed onto the end cap 16 in one method. Also, the end cap may be coupled to the second compartment in one method prior to placing the formula into the compartment. One method may include rotatably coupling the end cap to the second compartment. The second compartment may then be coupled to the first compartment. In one method, the first compartment may snap to the second compartment, but other coupling mechanisms such as, but not limited to, latches and threads may be used as well. The coupling in one method creates a seal between the first a second compartment to substantially prevent liquid from escaping from the two compartments. In one snapping method this is accomplished through having a distal end diameter 26, as best shown in FIG. 2*a*, which is less than a second compartment cavity diameter 35. The distal end may then be inserted into the second compartment cavity 36 such that at least a portion of the distal end sides press against the cavity wall 41, creating a seal.

Upon coupling the first compartment 12 to the second compartment 14, the distal end open portion 50, as best shown in FIG. 2*a*, may be aligned with the second compartment closed portion 49, as best shown in FIG. 5. Aligning these two sections keeps the two compartments substantially separate and substantially prevents the contents of the compartments from mixing.

In one method, the distal end open portion 50 and the second compartment closed portion 49 are aligned through rotating the first compartment 12 in a first direction and rotating the second compartment 14 in a second direction. One first direction may be a clockwise direction and one second direction may be a counterclockwise direction. The seal between the distal end 29 and the cavity 36 may not be broken in one method during rotation. Rotation may end when the stabilization coupling mechanism first portion 27 couples to a stabilization coupling mechanism second portion 38. This coupling may generally prevent the two compartments from rotating relative to each other. Alternatively, in one method, at least one extension 38, as best shown in FIG. 2*b* may couple to at least one pair of flanges 37, as best shown in FIG. 3*b*.

When the two compartments are substantially sealed from each other, liquid may be poured into the first compartment. In one method, water may be poured through a first compartment substantially open bore 22 into the compartment. The amount of liquid may be a specific amount selected for the type of liquid as well as the amount of formula measured and placed into the second compartment.

The top section 18 may then be coupled to the first compartment 12. In one embodiment, the top section is comprised of threads which mate with threads 21 on the first compartment. For example, the first compartment threads may be external proximal end 20 threads adapted to mate with top section internal threads. Coupling the top section to the proximal end may substantially close the proximal end bore 22 in order to prevent liquid from escaping the first compartment. Other methods may include different ways to substantially close the proximal and distal ends 29.

When both the first compartment 12 and the second compartment 14 are substantially closed and sealed, the first compartment distal end port open portion 50 may be aligned with the second compartment first end cavity open portion 50. Doing so may mix the liquid contained within the first compartment and the formula powder contained within the second compartment. In order to thoroughly dissolve the powder into the liquid, the baby bottle may be thoroughly agitated. For example, upon aligning the two open portions, the bottle may be shaken vigorously.

Alternative Embodiments

The embodiments of the baby bottle and methods of use as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure.

A method may also include using multiple second compartments. In such a method, formula may be placed in an additionally second compartment having an end cap coupled to the second end. An end cap or a lid may be coupled to the distal end of the additional second compartment. Upon feeding the baby with formula contained within a first second compartment, the bottle may be rinsed and washed, the lid or end cap removed from the distal end, and the additional second compartment may be coupled to the first compartment.

Wherein the second compartment may have a second end cap adapted to couple to the first end. By coupling a second end cap to a second compartment, formula may be stored in a detached from the second compartment. If the formula in the original second compartment is used, the original second compartment may be removed and the new second compartment may be coupled to the first compartment.

We claim:

1. A baby bottle comprising, (1) a first compartment having a proximal end and a distal end, the proximal end comprising a substantially open bore, and the distal end comprising, an at least partially closed port, and a stabilization coupling mechanism first portion;

(2) a top section having at least one of an outlet and inlet port, the top section adapted to couple to the first compartment proximal end; and (3) a second compartment having a first end and a second end, the first end comprising a partially closed cavity and a stabilization coupling mechanism second portion, the stabilization coupling mechanism second portion adapted to mate with the stabilization coupling mechanism first portion, generally preventing first compartment rotation relative to the second compartment, and wherein the first end is adapted to couple to the first compartment distal end, and the second end comprising a substantially open bore and a removably coupled end cap;

wherein (i) the second compartment first end, further comprises an inner diameter greater than a first compartment distal end outer diameter, and is adapted to snappably couple to the first compartment distal end, (ii) the stabilization coupling mechanism first portion comprises at least one flange generally positioned on an external surface of the first compartment, and (iii) the stabilization coupling mechanism second portion comprises at least one outer surface extension adapted to be received by the at least one flange.

2. The baby bottle of claim 1 wherein, the top section, is further adapted to, rotatably couple to the first compartment proximal end, substantially prevent liquid from exiting the bottle; and, further includes, a polymeric nipple.

3. The baby bottle of claim 1 wherein, the at least one flange comprises an external flange having an inner side comprising a plurality of ridges.

4. The baby bottle of claim 1 wherein, the open portion of the first compartment distal end is adapted to be generally sealed by the closed portion of the second compartment first end.

5. A combination comprising, the baby bottle of claim 1 infant formula; and liquid.

6. The combination of claim 5 wherein, the top section comprises a sippy-cup port.

7. The combination of claim 5 further including a plurality of second compartments.

8. A baby bottle comprising, (1) a first compartment having a proximal end and a distal end, the proximal end comprising a substantially open bore, and the distal end comprising, an at least partially closed port, and a stabilization coupling mechanism first portion;

(2) a top section having at least one of an outlet and inlet port, the top section adapted to couple to the first compartment proximal end; and (3) a second compartment having a first end and a second end, the first end comprising a partially closed cavity and a stabilization coupling mechanism second portion, the stabilization coupling mechanism second portion adapted to mate with the stabilization coupling mechanism first portion, generally preventing first compartment rotation relative to the second compartment, and wherein the first end is adapted to couple to the first compartment distal end, and the second end comprising a substantially open bore and a removably coupled end cap;

wherein (i)the end cap is adapted to rotatably couple to the second compartment (ii) the stabilization coupling mechanism first portion comprises at least one outer surface extensions, and (iii) the stabilization coupling mechanism second portion comprises at least one pair of second compartment flanges adapted to receive the stabilization mechanism first portion.

9. The baby bottle of claim 8 wherein, the top section, is further adapted to, rotatably couple to the first compartment proximal end, substantially prevent liquid from exiting the bottle; and, further includes, a polymeric nipple.

10. The baby bottle of claim 8 wherein, the open portion of the first compartment distal end is adapted to be generally sealed by the closed portion of the second compartment first end.

11. A method of preparing infant formula using a baby bottle the baby bottle comprising:

(1) a first compartment having a proximal end and a distal end, the proximal end comprising a substantially open bore, and the distal end including (i) an at least partially closed port, and (ii) a stabilization coupling mechanism first portion;

(2) a top section having at least one of an outlet and inlet port, the top section adapted to couple to the first compartment proximal end; and (3) a second compartment having a first end and a second end, the first end including (i) a partially closed cavity and (ii) a stabilization coupling mechanism second portion, the stabilization coupling mechanism second portion being adapted to mate with the stabilization coupling mechanism first portion, generally preventing first compartment rotation relative to the second compartment, the first end being adapted to couple to the first compartment distal end, and the second end comprising a substantially open bore and a removably coupled end cap; and the method comprising:

(a) measuring a desired amount of infant formula;

(b) coupling the end cap to the second compartment;

(c) placing the formula into the second compartment;

(d) coupling the second compartment to the first compartment;

(e) aligning a first compartment distal end port open portion with a second compartment first end cavity closed portion;

(f) pouring water through the first compartment proximal end substantially open bore into the first compartment;

(g) coupling the top section to the first compartment;

(h) aligning the first compartment distal end port open portion with a second compartment first end cavity open portion; and (i) dissolving the formula into the liquid.

12. The method of claim 11 wherein, said coupling the second compartment to a first compartment comprises, snapping a first compartment distal end into a second compartment first end cavity; and aligning a distal end open portion with a first end closed portion.

13. The method of claim 12 wherein the aligning a distal end open portion with a first end closed portion comprises, rotating the first compartment in a clockwise direction;

rotating the second compartment in a counterclockwise direction; and, coupling a stabilization coupling mechanism first portion and a stabilization coupling mechanism second portion.

14. The method of claim 11 wherein, said dissolving the formula into the liquid comprises agitating the baby bottle.

15. The method of claim 14 wherein, said agitating the baby bottle comprises shaking the baby bottle.

16. The method of claim 11 further comprising, placing formula in a new second compartment;

coupling a second end cap to the new second compartment;

removing original second compartment;

removing the second end cap; and coupling the new second compartment to the first compartment.

17. The method of claim 11 wherein, said coupling the second compartment to the first compartment comprises, creating a seal between a cavity wall and the distal end.

* * * * *